US005755489A

United States Patent [19]

Rossman et al.

[11] Patent Number: 5,755,489

[45] Date of Patent: May 26, 1998

[54] ADJUSTABLE CHAIR

[75] Inventors: Jon R. Rossman, Chelmsford; Bryan R. Hotaling, Arlington, both of Mass.

[73] Assignee: The First Years Inc., Avon, Mass.

[21] Appl. No.: 738,021

[22] Filed: Oct. 25, 1996

[51] Int. Cl.[6] ..... A47C 3/20

[52] U.S. Cl. ..... 297/338; 297/344.12; 297/440.15; 297/440.16; 297/452.21

[58] Field of Search ..... 297/338, 344.12, 297/440.15, 440.16, 451.11, 451.12, 452.21

[56] References Cited

U.S. PATENT DOCUMENTS

| | | | |
|---|---|---|---|
| 2,711,787 | 6/1955 | Hallowell, Jr. et al. | 297/344.12 X |
| 3,575,465 | 4/1971 | Dolby et al. | 297/338 X |
| 4,603,903 | 8/1986 | Moscovitch | 297/338 X |
| 4,854,638 | 8/1989 | Marcus et al. | 297/440.15 X |
| 4,919,485 | 4/1990 | Guichon | 297/440.15 X |
| 5,509,720 | 4/1996 | Croom | 297/440.16 X |
| 5,536,068 | 7/1996 | Valentor et al. | 297/452.21 X |
| 5,634,687 | 6/1997 | Gamble | 297/338 |

*Primary Examiner*—Peter M. Cuomo
*Assistant Examiner*—Rodney B. White
*Attorney, Agent, or Firm*—Fish & Richardson P.C.

[57] ABSTRACT

An adjustable chair with a seat having leg connectors and lock members along two sides, a chair back attached along and rising from the rear of the seat, and two side sections forming legs. Each side section comprises substantially vertical slots that releasably engage the leg connectors of the seat, thereby slidably attaching the legs to the seat, and multiple lock-engaging members at different heights, arranged for releasable engagement with the lock members for selective adjustment of the height of the seat. Resilient, integral handles disengage the lock members when pulled.

12 Claims, 6 Drawing Sheets

ADJUSTABLE CHAIR

BACKGROUND OF THE INVENTION

This invention relates generally to adjustable-height chairs, and specifically to a child's chair in which the seat may be raised or lowered relative to the legs.

As children grow and develop over the first several years of their lives, their needs change Particular to this invention, it is desirable to have a single chair that can be adaptable to meet their changing size and needs.

SUMMARY OF THE INVENTION

In one aspect of the invention a chair is provided, having a seat with leg connectors and lock members along opposite sides, and two side sections forming legs. Each side section has parallel, substantially vertical slots constructed in the side sections and arranged to releasably engage the leg connectors of the seat, slidably attaching the legs to the seat along opposing side edges of the seat. Each side section also has multiple lock-engaging members at different heights, arranged for releasable engagement with the lock members of the seat for selective adjustment of the height of the seat.

Preferred embodiments contain at least one of the following features: the leg connectors are integral with the seat; the slots have a first length with an extended rib to retain an outer portion of said leg connectors, and a second length of sufficient width for the outer portion of the leg connectors to pass, the second length being longer than the leg connectors; the ribs in the slots in a side section extend away from adjacent walls of the slots, the outermost walls of the ribs being spaced apart a distance approximately equal to the distance between the inwardly facing surfaces of stems connecting the outer portions of the leg connectors to the seat; the horizontal width of the rib is approximately equal to the distance between the seat and an inner surface of the outer plate portion of the leg connector.

In some embodiments the lock-engaging members are exposed upwardly facing supporting surfaces of elongated recesses, and in a preferred configuration the lock members have integrally formed tabs extending from side surfaces of the seat.

In some arrangements the seat has graspable handles connected to the locks, constructed such that the lock members are disengaged when the handles are pulled. The lock members preferrably normally extend toward an outward, locking position. In some cases the handles are integrally formed with the seat, the seat resiliently deforming when the handles are pulled inward to disengage the lock members.

Other embodiments of the invention may contain one or more of the following features: the recesses and lock members have chamfered upper surfaces; the chair includes a chair back with vertical attachment tabs arranged to engage mating slots in the seat; and the seat has a back-locking member extending from a rear face arranged to engage a recess in the chair back, thereby lockably attaching the chair back to the seat.

As provided, the chair may be advantageously adjusted to meet the needs of the growing child, and easily assembled.

DESCRIPTION OF THE PREFERRED EMBODIMENT

The figures illustrate a preferred embodiment of the chair 9 of the present invention as an assembly of molded resin components, comprising a seat 10, a back portion 12, and two side sections 14.

Figure 1:
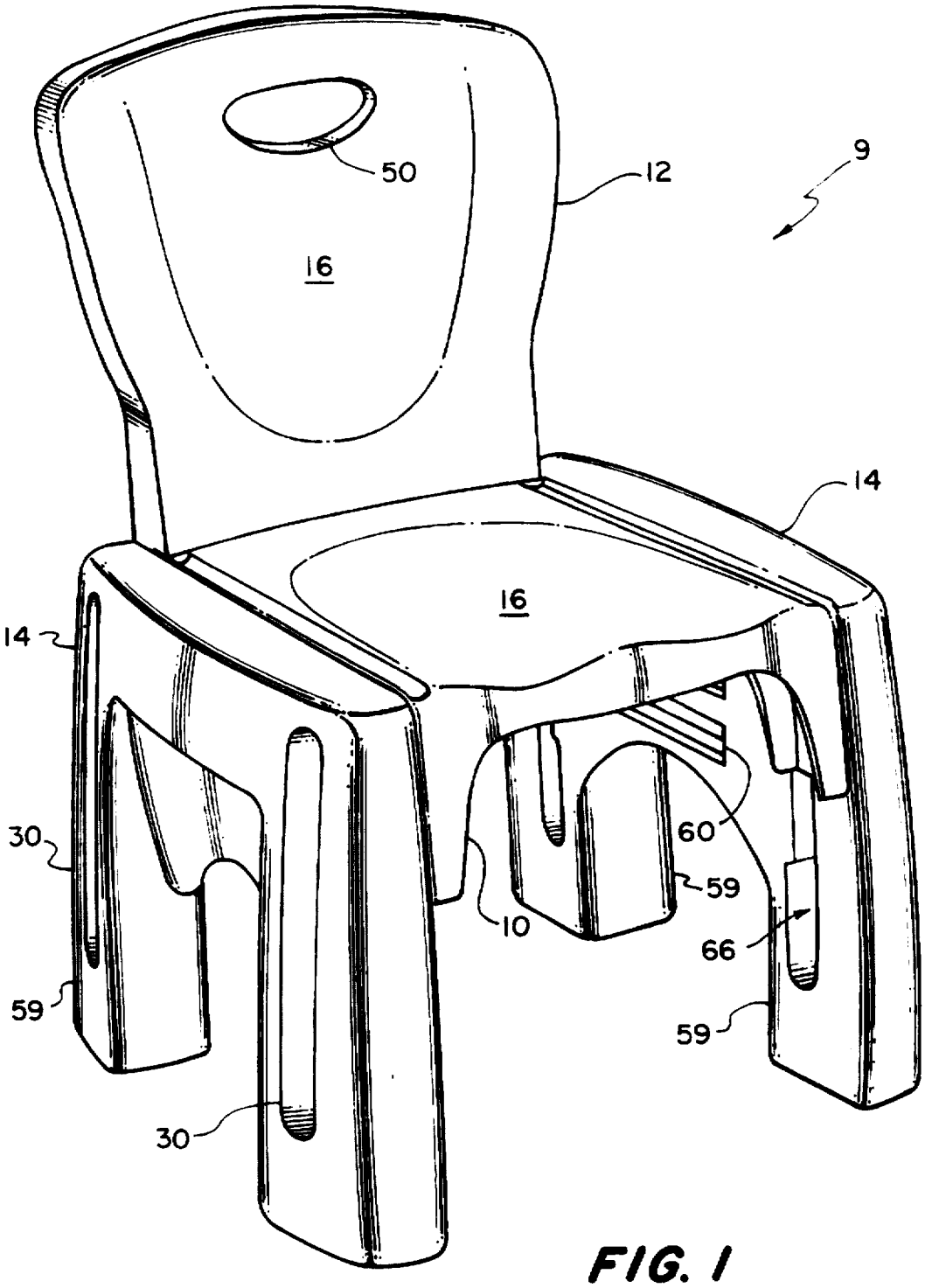
FIG. 1 is a perspective view of a chair according to the invention, at full height.
Figure 2:
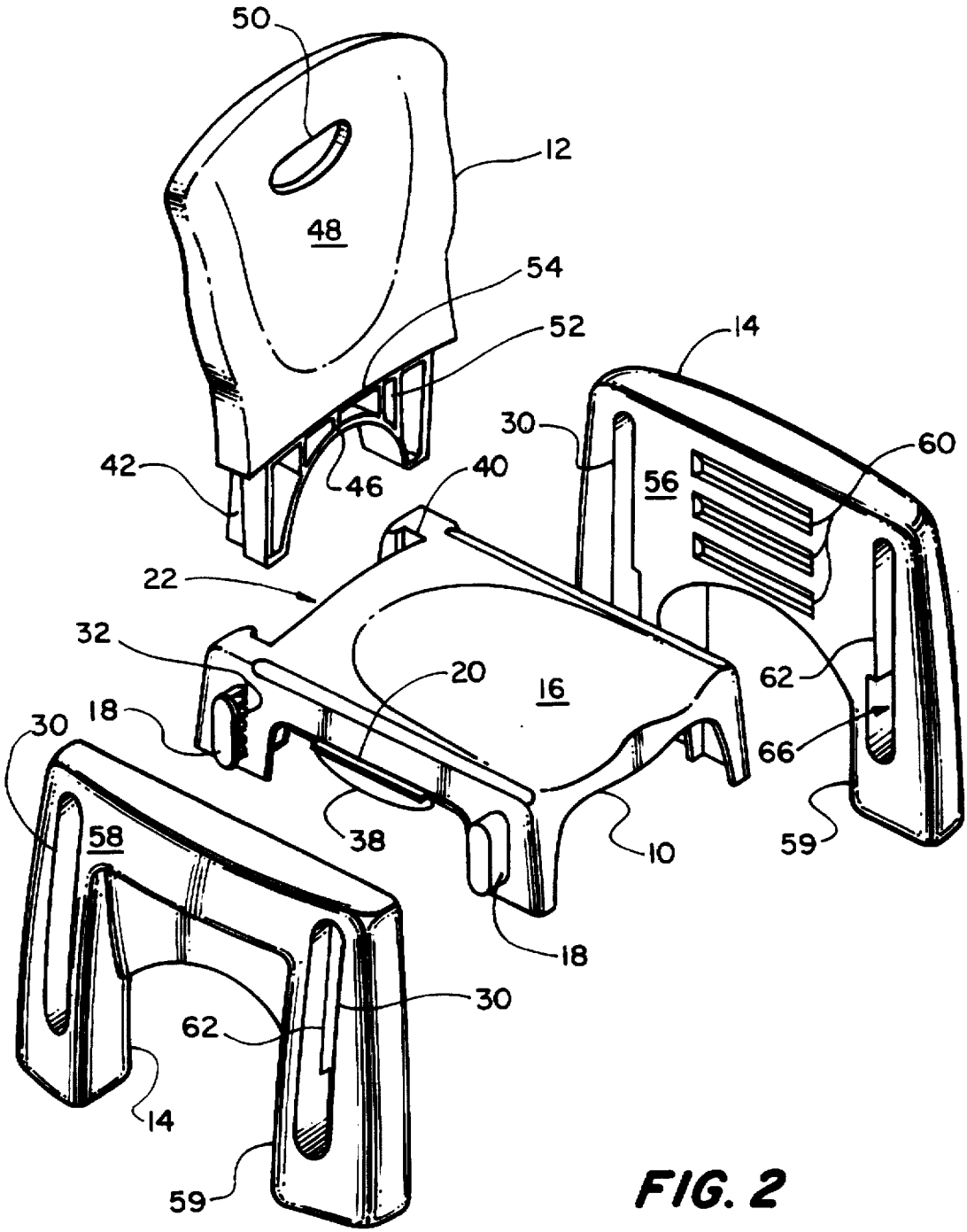
FIG. 2 is an exploded view of the chair.

Referring first to FIGS. 1 and 2, seat 10 is a unitary injection molded piece with a relatively flat, broad upper surface 16 shaped appropriately to be comfortable for sitting. On the sides of the seat are vertically elongated connectors 18 for attaching the side sections 14. Between the connectors are lock members 20, one on each side, for securing the position of the seat 10 along the side sections 14 once attached, thereby establishing the height of the seat. Toward the rear of the seat is a slotted opening 22 for attaching the chair back 12. The assembled chair 9 is shown, with the seat 10 adjusted to full height, in FIG. 1.

Figure 5:
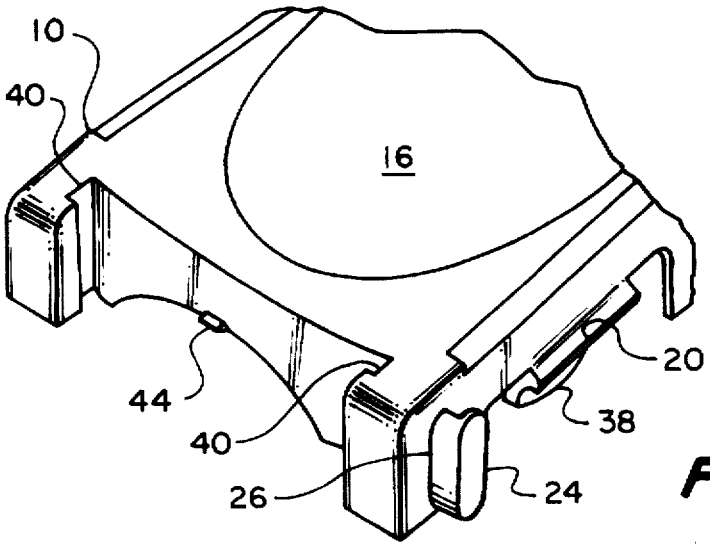
FIG. 5 As a fragmentary view of the rear portion of the seat.
Figure 7:
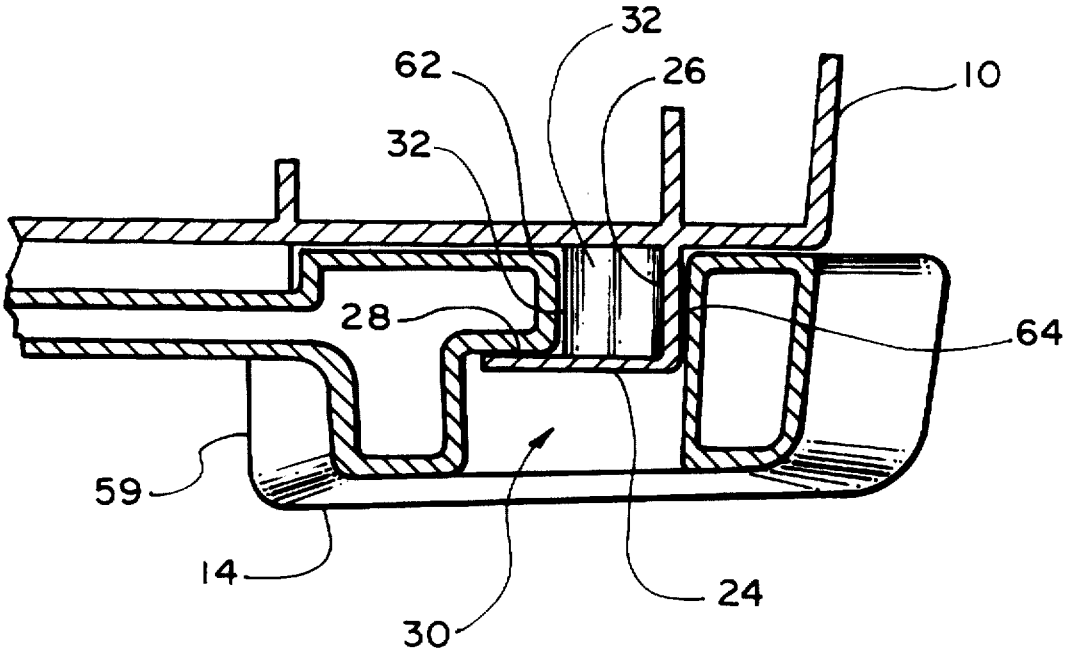
FIG. 7 is a fragmentary cross-sectional view, taken along line 7—7 in FIG. 4.

As seen in FIGS. 2, 5 and 7, the leg connectors 18 comprise an outer plate portion 24 and a narrower stem 26 offset to one side of the outer plate portion 24 and integrally connecting it to the seat 10. This arrangement provides an exposed inner surface 28 of the outer plate portion to hold the side section 14 against the seat 10 when the connector is positioned within a slot 30 in the side section. The molded stem 26 contains several thin reinforcing fins 32 to increase the rigidity of the connector.

Figure 6:
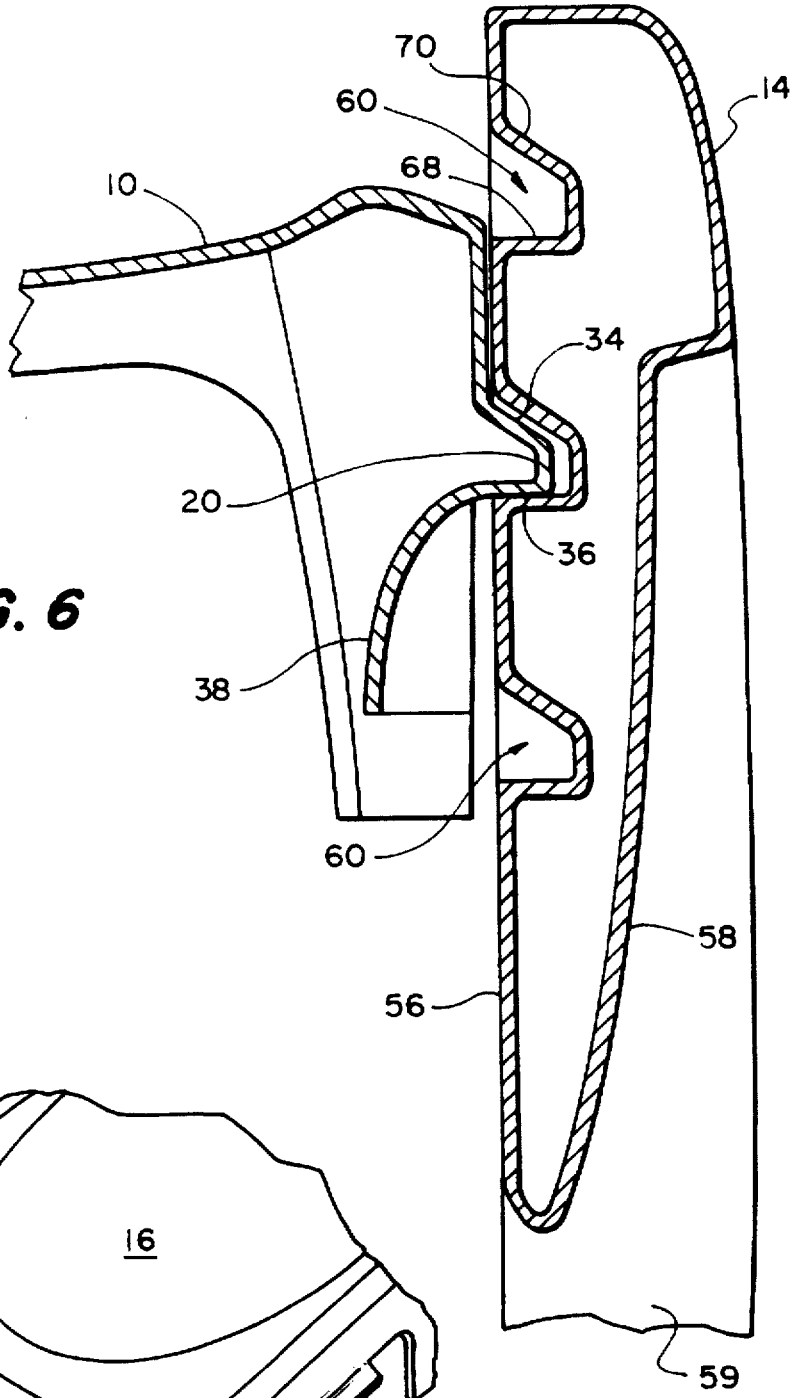
FIG. 6.is a fragmentary cross-sectional view, taken along line 6—6 in FIG. 4.

The lock members 20, shown in a cross-sectional view in FIG. 6, have a chamfered or tapered upper cam surface 34 and a horizontal lower surface 36. When the lock member is engaged to lock the seat 10 in place, vertical load from the seat is transferred through the lower surface 36 into the structure of the side section 14. Integrally molded with the lock member 20 is a curved, graspable web 38 that serves as a handle to manually pull the lock member 20 inward toward the center of the chair to disengage it from the side section 14 while adjusting the height of the seat 10.

The slots 40 at the rear of the seat 10 for attaching the chair back 12 are best viewed in FIG. 5. The slots accept mating tabs 42 on the chair back as the back is slid vertically downward during attachment. A small integral resilient tab 44 at the back of the seat 10 between the slots 40 engages an exposed lower lip 46 at the base of the chair back, shown in FIG. 2, when the back is fully lowered into place, securing the chair back 12 to the seat 10. Unlike the locking lock members 20 that secure the side sections to the seat, tab 44 has no handle for disengaging the tab as the seat and chair back are not intended to be disconnected after assembly.

Like the seat 10, the back 12 is also a unitary injection-molded resin component. The forward face 48 of the back is broad and relatively flat and rigid, providing a suitable support for the back of someone seated in the chair. A hole 50 is provided near the top of the chair back as a hand-hold for convenient lifting of the chair. As shown in FIG. 2, the lower portion of the back comprises reinforcing ribs 52 in addition to tabs 42. The central rib 54 is recessed from the forward edge of the lower surface of the back, exposing the lip 46 for engaging the tab 44 at the back of the seat to lock the back in place.

The side sections 14 are preferably blow-molded for improved rigidity and have inner 56 and outer 58 membrane surfaces. The side sections 14 each define two integral chair legs 59 at the lower end of the section. Each side section 14 has two vertical slots 30 extending through legs 59 and three horizontal recesses 60 forming lock-engaging members in the inner surface 56.

The vertical slots 30 have a width greater than the width of the connector 18 and a height extending between the uppermost recess 60 to a position below the lowermost recess 60 a distance greater than the length of connectors 18. An inner raised rib 62 extends from the top of each slot along one side of each slot 30 in a side section 14 nearest the other slot 30 in the side section, narrowing the effective width of the inner portion 64 of the slot to a width less than the connector width. The ribs 62 in the pair of slots 30 in a side section 14 extend away from the adjacent walls of the pair of slots, the outermost walls of the lips being spaced apart a distance approximately equal to the distance between the inwardly facing fins 32 of the pair of connectors 18 on one side of seat 10, permitting sliding contact of ribs 62 with fins 32 when assembled. Rib 62 stops above the lower section 66 of each slot a distance at least as great as the length of connector 18. The horizontal width of the lip 62 is approximately equal to the distance between seat 10 and the inner surface of the outer plate portion 24 of connector 18, permitting sliding contact of rib 62 with facing surfaces of seat 10 and plate portion 24 when assembled. With this arrangement, the side sections 14 can be attached to the seat 10 by placing the leg connectors 18 into the lower section 66 of the slots 30 and sliding the side section downwards so that the inner face 28 of the outer portion of the leg connector engages the rib 62 within the slot to hold the side section against the seat, as shown in FIG. 7.

Figure 3:
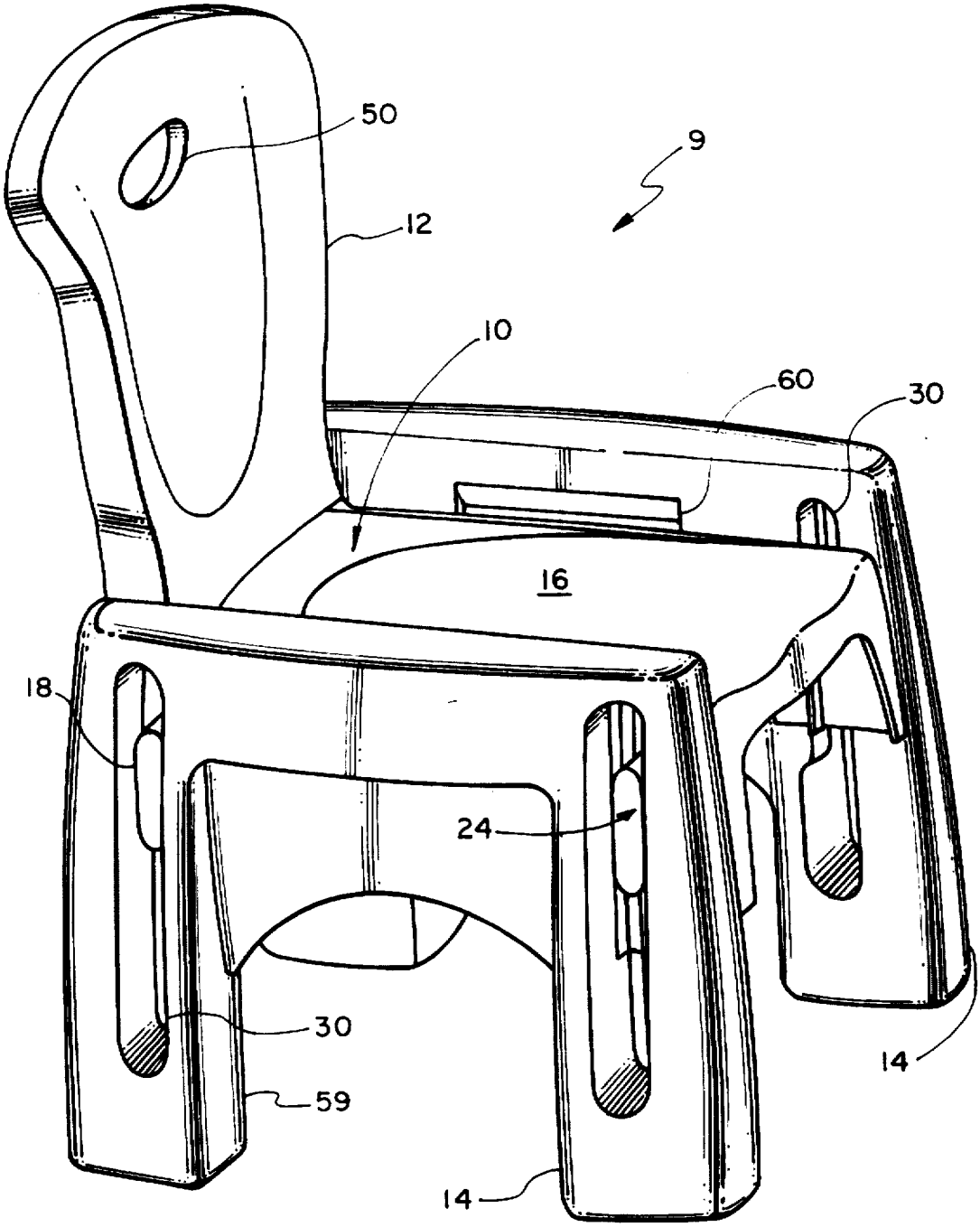
FIG. 3 is a perspective view of the chair, with the height lowered.
Figure 4:
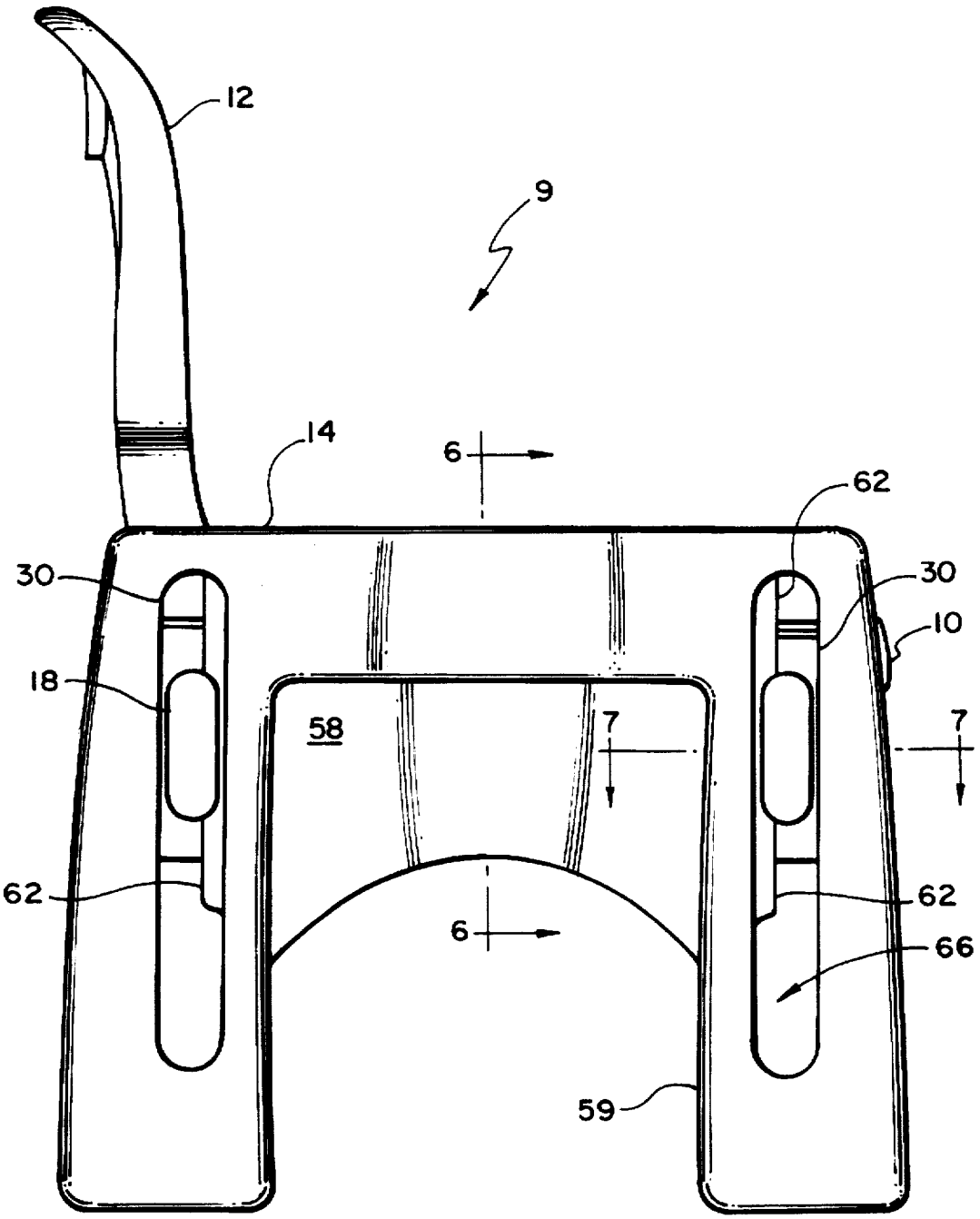
FIG. 4 is a side view of the chair, with the height lowered.

The horizontal recesses 60 are employed as selectable engaging stops and supports for the leg locking lock members 20, as illustrated in FIG. 6. The recesses have substantially horizontal lower surfaces 68 upon which the lock members rest, and chamfered upper surfaces 70. The chamfers or tapers on the upper surfaces of the lock members and recesses help to disengage the lock members 20 when the seat 10 is moved upwards with respect to the side sections 14. When the handle web 38 is pulled inward, the material of the seat in the vicinity of the lock member 20 is resiliently deformed, pulling the lock member out of engagement with the recess 60 to aid in adjusting the height of the chair seat. FIGS. 3 and 4 illustrate the chair 9 with the seat so adjusted to a lower position.

In use, side sections 14 are attached to seat 10 by placing the leg connectors 18 on one side of the seat in the lower portions 66 of slots 30 in a side section, with the upper end of the side section extending above the upper surface 16 of the seat. The seat 10 is then raised with respect to the side section 14, sliding connectors 18 up the slots 10 so that the ribs 62 within the slots are disposed between facing surfaces of seat 10 and outer plate portions 24, while pulling inward on resilient web 38, until the seat 10 has reached a height at which the lock member 20 is aligned with the desired lock-engaging recess 60 in the side section 14. The web 38 is then released to engage the lock member 20 with the recess 60 to lock the seat in position. The opposite side section 14 is attached to the seat 10 in a similar fashion.

The chair back 12 is attached to the seat 10 by placing tabs 42 on back 12 in slots 40 in seat 10, and sliding the back downward along the slots until locking tab 44 on seat 10 engages the lower edge 46 of the chair back 12 to secure the back to the seat.

To adjust the height of the seat 10, resilient handle webs 38 are pulled inward, away from the adjacent side sections 14, to disengage lock members 20 from recesses 60. With the lock members thus disengaged, seat 10 is slidably vertically moved with respect to side sections 14 until lock members 20 are vertically aligned with the recesses 60 that correspond to the desired seat height. Once the seat 10 is at the desired height, handles 38 are released to re-secure the seat.

Other embodiments of the invention which will occur to those skilled in the art and which are within the scope of the claims. For instance, the number of lock member-engaging recesses 60 is not limited to three, and the arrangement and shape of the connectors 18, slots 30, lock members 20 and recesses 60 may vary, as long as their function is maintained.

What is claimed is:

1. A chair comprising:

a seat having leg connectors and lock members along opposite sides of the seat, the lock members being integral with the seat; and two side sections, each integrally forming two legs of the chair, each side section comprising:

parallel, substantially vertical slots constructed in the side sections and arranged to vertically slidably receive and to releasably engage the leg connectors of the seat, slidably attaching the legs to the seat along opposing side edges of the seat; and multiple lock-engaging members at different heights, arranged for releasable engagement with said lock members for selective adjustment of the height of said seat.

2. The chair of claim 1 in which two leg connectors are provided on each side of the seat, the leg connectors each comprise a stem, integrally connected to the seat at one end and an outer portion at the other end of the stem having a width greater than that of the stem, and in which the slots comprise a first length having an extended rib to retain the outer portions of said leg connectors, and a second length of sufficient width for the outer portions of the leg connectors to pass therethrough, the second length being longer than said leg connectors.

3. The chair of claim 2 in which the ribs in the slots in each side section extend away from adjacent walls of the slots in the same side section, the ribs in such same side section each having a wall facing outwardly away the wall of the other rib in such same side section, the outwardly facing walls of such ribs being spaced apart a distance approximately equal to the distance between adjacent facing surfaces of the stems on one side of the seat connecting said outer portions of said leg connectors to said seat.

4. The chair of claim 2 in which each rib has a horizontal width, extending in a direction from one side to the other side of a side section, approximately equal to the distance between said seat and an inner surface of the outer portion of said leg connector.

5. The chair of claim 1 in which the side sections each have elongated recesses on the sides facing the seat and the lock-engaging members are exposed upwardly facing supporting surfaces of the elongated recesses.

6. The chair of claim 5 in which the recesses and lock members have chamfered upper surfaces.

7. The chair of claim 5 in which the lock members comprise integrally formed tabs extending from side surfaces of the seat.

8. The chair of claim 1 or claim 7 in which the seat further comprises graspable handles connected to the locks, members, constructed such that the lock members are disengaged when the handles are pulled.

9. The chair of claim 8 in which the lock members normally extend toward an outward, locking position.

10. The chair of claim 9 in which the handles are integrally formed with the seat, the seat resiliently deforming when the handles are pulled inward to disengage the lock members.

11. The chair of claim 1 in which the chair further comprises a chair back with vertical attachment tabs arranged to engage mating slots in the seat.

12. The chair of claim 11 in which the seat comprises a back-locking member extending from a rear face arranged to engage a recess in said chair back, thereby lockably attaching the chair back to the seat.

* * * * *